US009365056B2

(12) United States Patent
Kim

(10) Patent No.: US 9,365,056 B2
(45) Date of Patent: Jun. 14, 2016

(54) APPARATUS FOR PROTECTING PAPER SKEW OF PRINTER

(71) Applicant: SHIN HEUNG PRECISION CO., LTD., Gyeonggi-do (KR)

(72) Inventor: Han Bong Kim, Seoul (KR)

(73) Assignee: Shin Heung Precision Co, LTD (KR)

( * ) Notice: Subject to any disclaimer, the term of this patent is extended or adjusted under 35 U.S.C. 154(b) by 0 days.

(21) Appl. No.: 14/716,936

(22) Filed: May 20, 2015

(65) Prior Publication Data

US 2015/0336407 A1 Nov. 26, 2015

(30) Foreign Application Priority Data

May 22, 2014 (KR) ..... 10-2014-0061470

(51) Int. Cl.

| | |
|---|---|
| ***B41J 11/04*** | (2006.01) |
| ***B41J 11/00*** | (2006.01) |
| ***B41J 15/04*** | (2006.01) |
| ***B65H 23/032*** | (2006.01) |
| ***B65H 23/038*** | (2006.01) |
| *B41J 11/70* | (2006.01) |

(52) U.S. Cl.

CPC ..... *B41J 11/04* (2013.01); *B41J 11/0045* (2013.01); *B41J 15/046* (2013.01); *B65H 23/038* (2013.01); *B65H 23/0322* (2013.01); *B41J 11/70* (2013.01); *B65H 2404/742* (2013.01); *B65H 2601/272* (2013.01); *B65H 2801/12* (2013.01)

(58) Field of Classification Search

CPC ..... B41J 11/02; B41J 11/04; B41J 11/053; B41J 11/057; B41J 11/06; B41J 11/08; B41J 11/10; B41J 11/13; B41J 25/304; B41J 25/308; B41J 25/3082; B41J 25/3084; B41J 25/3086; B41J 25/3088; B41J 25/312; B41J 25/316

USPC ..... 347/220–223, 197, 198, 101, 104, 106, 347/171, 14, 16, 17

See application file for complete search history.

(56) References Cited

U.S. PATENT DOCUMENTS

| | | | |
|---|---|---|---|
| 3,737,091 | A | 6/1973 | Barta et al. |
| 5,244,138 | A | 9/1993 | Blanding et al. |
| 2013/0278702 | A1 | 10/2013 | Ishii et al. |

FOREIGN PATENT DOCUMENTS

| | | |
|---|---|---|
| JP | S60 19635 | 1/1985 |
| JP | 2001 293940 | 10/2001 |
| JP | 2002361960 | 12/2002 |
| JP | 2009 107773 | 5/2009 |

OTHER PUBLICATIONS

Search Report from corresponding Korean Application KR 10-2014-0061740.

Search Report from corresponding European Application EP 15 168 457.8.

*Primary Examiner* — Kristal Feggins

(74) *Attorney, Agent, or Firm* — Anderson Gorecki & Rouille, LLP

(57) ABSTRACT

In one aspect of the present disclosure, an apparatus for protecting a paper skew of a printer comprises a printer head unit comprising a support shaft installed on a support frame and a thermal printer head installed on the support frame to print printing paper, a platen roller unit comprising a roller frame and a platen roller, and paper guides formed at both sides of the support shaft.

20 Claims, 9 Drawing Sheets

APPARATUS FOR PROTECTING PAPER SKEW OF PRINTER

CROSS-REFERENCE TO RELATED APPLICATION(S)

This application claims priority to Korean Patent Application No. 10-2014-0061470, filed on May 22, 2014, the disclosure of which is incorporated herein by reference in its entirety.

FIELD OF THE DISCLOSURE

Exemplary embodiments of the present disclosure relate to an apparatus for protecting a paper skew of a printer.

DESCRIPTION OF THE RELATED ART

Generally, a POS printer has been used to print a simple receipt, specifications, etc. As the POS printer, a thermal printer has been mainly used. Generally, the thermal printer which is a kind of a non-impact printer uses thermal recording paper (hereinafter, referred to as "printing paper") which is special paper reacting to heat. That is, the thermal printer is a printing apparatus which applies heat to the printing paper using a thermal printer head (thermal print head) to implement coloring, thereby representing characters or pictures. In the thermal printer, when a heating element which is included in the thermal printer head and corresponds to a printing dot is applied with a voltage to make a current flow, the heating element is applied with heat to perform printing on the printing paper. A kind of the thermal printer is various depending on a shape or a structure thereof and various kinds of thermal printers have been used.

FIGS. 1 and 2 are perspective views illustrating an embodiment of a POS printer formed of a thermal printer disclosed in U.S. Pat. No. 1,297,646. As illustrated in FIGS. 1 and 2, the thermal printer includes a body casing 100 in which a printer head unit 300 comprising a thermal printer head (not illustrated) for printing is mounted as well as a cover frame 200 which is rotatably opened and closed with respect to the body casing 100 and is mounted with a platen roller unit 400 comprising a platen roller 410, where the platen roller unit 400 is disposed to face the printer head unit 300.

The body casing 100 includes a receiving part 101 for receiving printing paper P which is rolled in the body casing in a roll form. Further, the body casing 100 includes a component which may convey the printing paper P from the receiving part 101 to the thermal printer head (not illustrated) and then draw the printing paper P to an outside of the body casing 100 after a printing job ends. That is, the printing paper P received in the receiving part 101 is conveyed to the thermal printer head (not illustrated) by the platen roller 410 which rotates by a paper conveying motor 320 and an idle roller 310 which guides the printing paper P on a conveying path of the printing paper P.

As described above, the platen roller 410 is disposed on the platen roller unit 400 of the cover frame 200 and the idle roller 310 is disposed on the printer head unit 300 which is mounted in the body casing 100. That is, the platen roller and the idle roller each serves to convey and guide the printing paper P at a position at which the platen roller and the idle roller face each other. Further, the paper conveying motor 320 is continuously driven while the thermal printer head performs the printing job on the printing paper P. Accordingly, the platen roller 410 rotates to convey and draw the printing paper P to the outside of the body casing 100.

However, a skew may occur where the printing paper P is transported in a skewed manner due to an imbalance between components involved in the conveyance of the printing paper or other complicated factors during the conveyance of the printing paper P while the thermal printer as described above performs the printing job. When the skew occurs during the conveyance process for the printing job and thus the printing paper P is not conveyed in a straight manner to and correctly aligned at the thermal printer head side but is conveyed in a skewed manner, contents printed on the printing paper P may be printed out of line on the whole and a corner folded phenomenon may occur on the sides of the printing paper P. Further, in severe cases, the situations in which the printing paper P is crumpled (or folded) or torn while the printing paper P is transported out may occur.

Therefore, as illustrated in FIGS. 1 and 2, to prevent the skew phenomenon from occurring during the conveyance of the printing paper P, the existing thermal printer includes the paper guide 330 for guiding the printing paper P to a portion with which the idle roller 310 guiding the conveyance of the printing paper P together with the platen roller 410 is mounted in the correctly aligned state. The paper guide 330 included in the thermal printer as illustrated in FIGS. 1 and 2 is a portion where the idle roller 310 is mounted on, and at the same time it performs the role of a holder in which both shaft portions of the platen roller 410 may be fitted when the printer head unit 300 and the platen roller unit 400 are disposed to face each other. As such, as a portion supporting both ends of the idle roller 310 has a structure protruding in a fixed fence form, the paper guide 330 may have a structure which guides the conveyance of the printing paper P in the correctly aligned state while preventing the printing paper P from being skewed on the conveying path since both sides of the printing paper P conveyed by the platen roller 410 are biased to one side during the conveyance of the printing paper P.

However, when the paper guide 330 is formed in the fixed fence form like the paper guide 330 illustrated in FIGS. 1 and 2, the conveyance load of the printing paper P may be increased due to the contact of the printing paper P with the paper guide 330 during the conveyance of the printing paper P. Further, the increase in the conveyance load of the printing paper P leads to a driving load loss in the conveyance mechanism of the printing paper P, and as a result, such structural problem of the paper guide may work against the effort of maximally improving a printing speed.

In particular, in the case in which the paper guide 330 is configured in the fixed fence form as described above, the side of the printing paper P and the paper guide 330 keeps the contact state when the printing paper P is guided not to be biased to one side during the conveyance of the printing paper P. As a result, a load occurs due to a friction between the paper guide 330 and the side of the printing paper P. Further, a scratch occurs on the paper guide 330 due to the printing paper P together with the load due to the above-mentioned friction. When this phenomenon repeatedly occurs due to the long-term use of the thermal printer and thus the abrasion or denting phenomenon due to the accumulation of the scratch occurs, the function of the paper guide 330 may deteriorate and the original function of the paper guide 330 to protect the skew from occurring may be lost.

SUMMARY OF THE DISCLOSURE

An object of the present disclosure is to provide an apparatus for protecting a paper skew of a printer in which circular paper guides are additionally installed at each of both ends of a support shaft of an idle roller guiding the conveyance of printing paper together with a platen roller in a printer to convey the printing paper while rotating the idle roller and the circular paper guide together at the time of the conveyance operation of the printing paper so as to remove a load due to a friction of the printing paper with the circular paper guides, thereby minimizing a load due to the conveyance of the printing paper and stably suppressing occurrence of a skew due to an action of the paper guides.

Another object of the present disclosure is to provide an apparatus for protecting a paper skew of a printer in which a semi-circular printing paper guide curved surface which guides the conveyance of printing paper along a semi-circular curved surface on a roller frame mounted with a platen roller so as to let the printing paper surface-contact a circular paper guide is formed on a roller frame, and as a result, the printing paper is conveyed to the paper guide in a semi-circular curved structure to be conveyed in the surface-contact state on the contact surface of the paper guide so as to contact the printing paper with the paper guide without a relative sliding motion and form a condition to make the printing paper strongly withstand single-sided biasing of the printing paper, thereby efficiently suppressing occurrence of a skew.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In one aspect of the present disclosure, an apparatus for protecting a paper skew of a printer comprises a printer head unit comprising a support shaft installed on a support frame and a thermal printer head installed on the support frame to print printing paper, a platen roller unit comprising a roller frame and a platen roller, and paper guides formed at both sides of the support shaft.

In various embodiments of the present disclosure, the paper guide comprises bodies configured to protrude at both ends of the support shaft and flange parts formed at the both ends of the support shaft and the flange parts protruding more than a diameter of an outer circumferential surface of the bodies. The flange parts of the paper guides are integrally formed with the bodies and the flange parts protrude from front ends of each of the bodies along the outer circumferential surface of the bodies. The printer head unit further comprises an idle roller inserted into the support frame to convey the printing paper as well as the bodies formed to flank the idle roller and to face each other at the both ends of the support shaft. Further, the diameter of the outer circumferential surface of the bodies is configured to be the same as that of an outer circumferential surface of the idle roller.

In various embodiments of the present disclosure, the paper guides comprise bodies formed to protrude along a length direction of the support shaft and flange parts formed at both ends of the support shaft, where the flange parts protrude more than a diameter of an outer circumferential surface of the bodies. The bodies are integrally formed with the support shaft.

In various embodiments of the present disclosure, the platen roller unit further comprises a printing paper guide curved surface formed on the roller frame to guide a conveyance of the printing paper, and the printer head unit further comprises an idle roller inserted into the support frame to convey the printing paper. Moreover, the printing paper guide curved surface is formed on the roller frame as a semi-circular curved surface to closely couple the idle roller with the paper guides while enclosing the idle roller and the paper guides to face each other. The printer head unit further comprises a movable blade installed on the support frame to face the idle roller and the movable blade configured to cut a printed version of the printing paper. In addition, the platen roller unit further comprises a fixed blade installed at one side of the roller frame to cut the printing paper by driving the movable blade up-and-down.

In another aspect of the present disclosure, an apparatus for protecting a paper skew of a printer comprises a printer head unit comprising a support shaft installed on a support frame and a thermal printer head installed on the support frame to print printing paper, an idle roller inserted into the support frame to convey the printing paper, and bodies formed to flank the idle roller and to face each other at both ends of the support shaft, a platen roller unit comprising a roller frame and a platen roller, and paper guides formed at both sides of the support shaft.

In various embodiments of the present disclosure, a diameter of an outer circumferential surface of the bodies is configured to be the same as that of an outer circumferential surface of the idle roller.

In yet another aspect of the present disclosure, an apparatus for protecting a paper skew of a printer comprises a printer head unit comprising a support shaft installed on a support frame and a thermal printer head installed on the support frame to print printing paper, an idle roller inserted into the support frame to convey the printing paper, and a movable blade installed on the support frame to face the idle roller and the movable blade configured to cut a printed version of the printing paper, a platen roller unit comprising a roller frame and a platen roller, and paper guides formed at both sides of the support shaft.

In various embodiments of the present disclosure, the platen roller unit further comprises a printing paper guide curved surface formed on the roller frame to guide a conveyance of the printing paper. The printing paper guide curved surface is formed on the roller frame as a semi-circular curved surface to closely couple the idle roller with the paper guides while enclosing the idle roller and the paper guides to face each other. The platen roller unit further comprises a fixed blade installed at one side of the roller frame to cut the printing paper by driving the movable blade up-and-down. The paper guides comprise bodies configured to protrude at both ends of the support shaft and flange parts formed at the both ends of the support shaft and the flange parts protruding more than a diameter of an outer circumferential surface of the bodies. The flange parts of the paper guides are integrally formed with the bodies and the flange parts protrude from front ends of each of the bodies along the outer circumferential surface of the bodies. The bodies are configured to flank the idle roller and to face each other at the both ends of the support shaft.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

Figure 1:
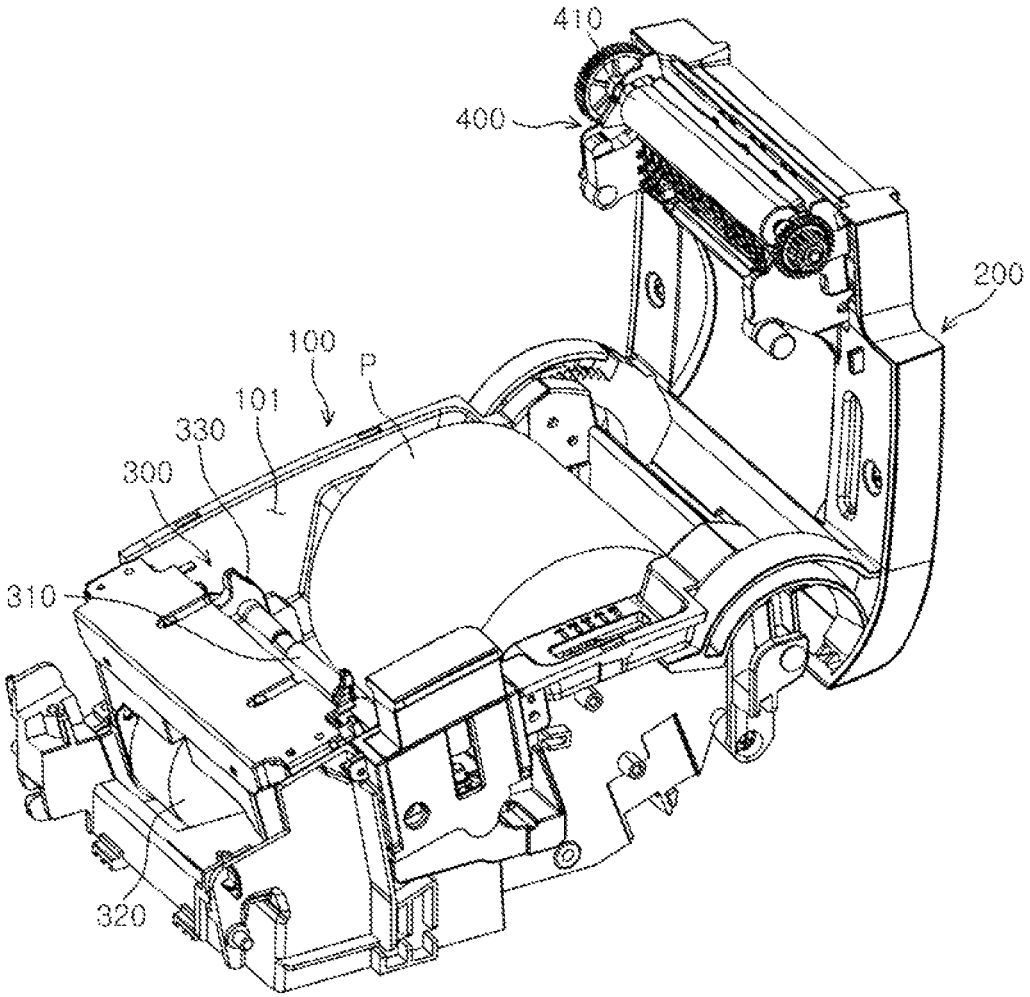
FIG. 1 is a perspective view of main components of a fixed paper guide in the printer according to the related art disclosed in U.S. Pat. No. 1,297,646.
Figure 2:
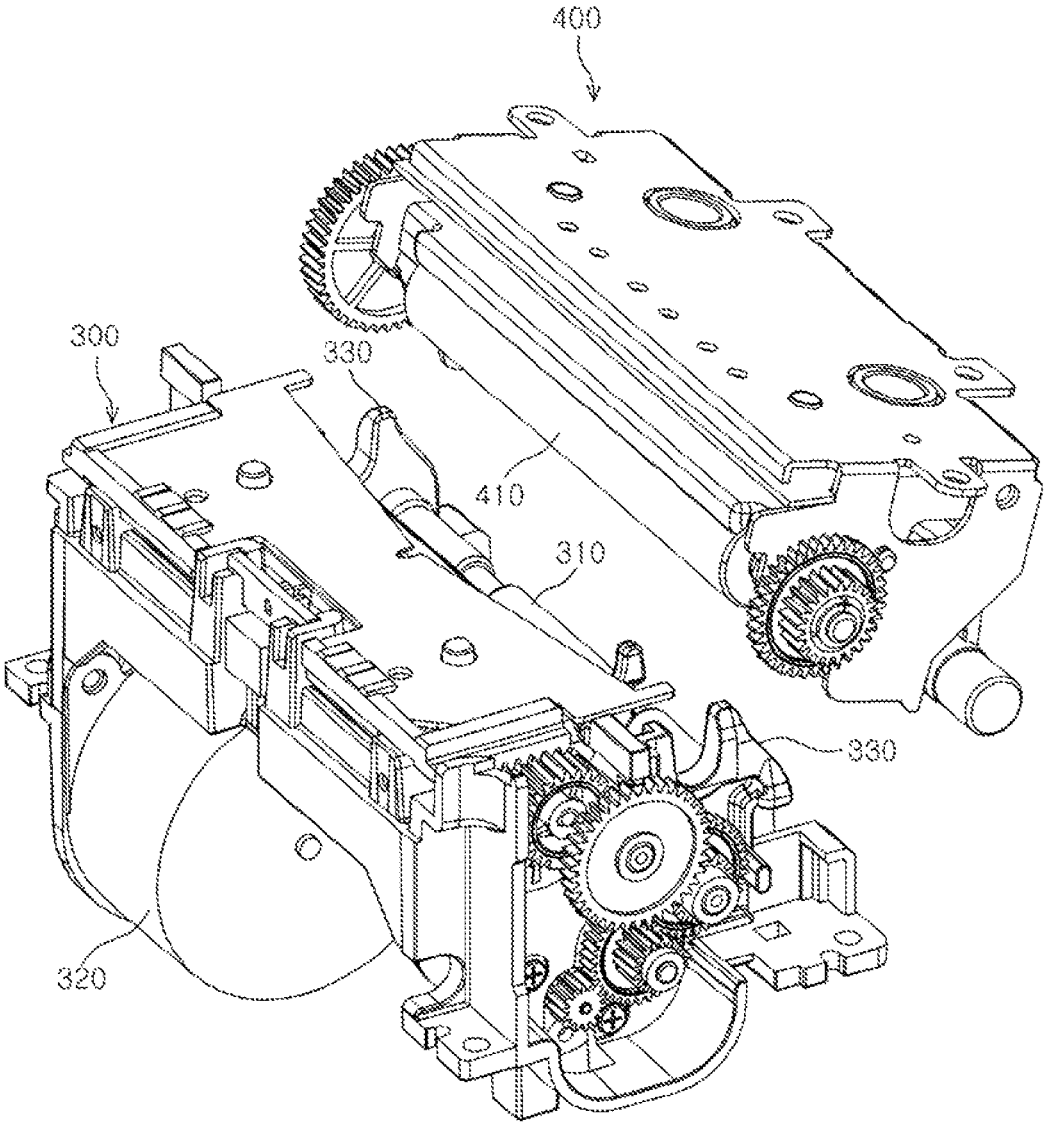
FIG. 2 is an exploded perspective view illustrating a state in which a printer head unit and a platen roller unit face each other in a state in which a body casing and a cover frame are removed from the printer according to the related art illustrated in FIG. 1.

Other features of the present embodiments will be apparent from the accompanying drawings and from the detailed description that follows.

DESCRIPTION OF SPECIFIC EMBODIMENTS

Hereinafter, exemplary embodiments of the present disclosure will be described in more detail with reference to the accompanying drawings.

In this case, a thickness of lines, a size of components, or the like illustrated in the accompanying drawings for describing the exemplary embodiments of the present disclosure may be exaggerated or omitted for clarity and convenience of description and terms denoted by reference numerals of the drawings are defined in consideration of functions of the present disclosure, which may be changed depending on an operator's intention or a practice.

Figure 3:
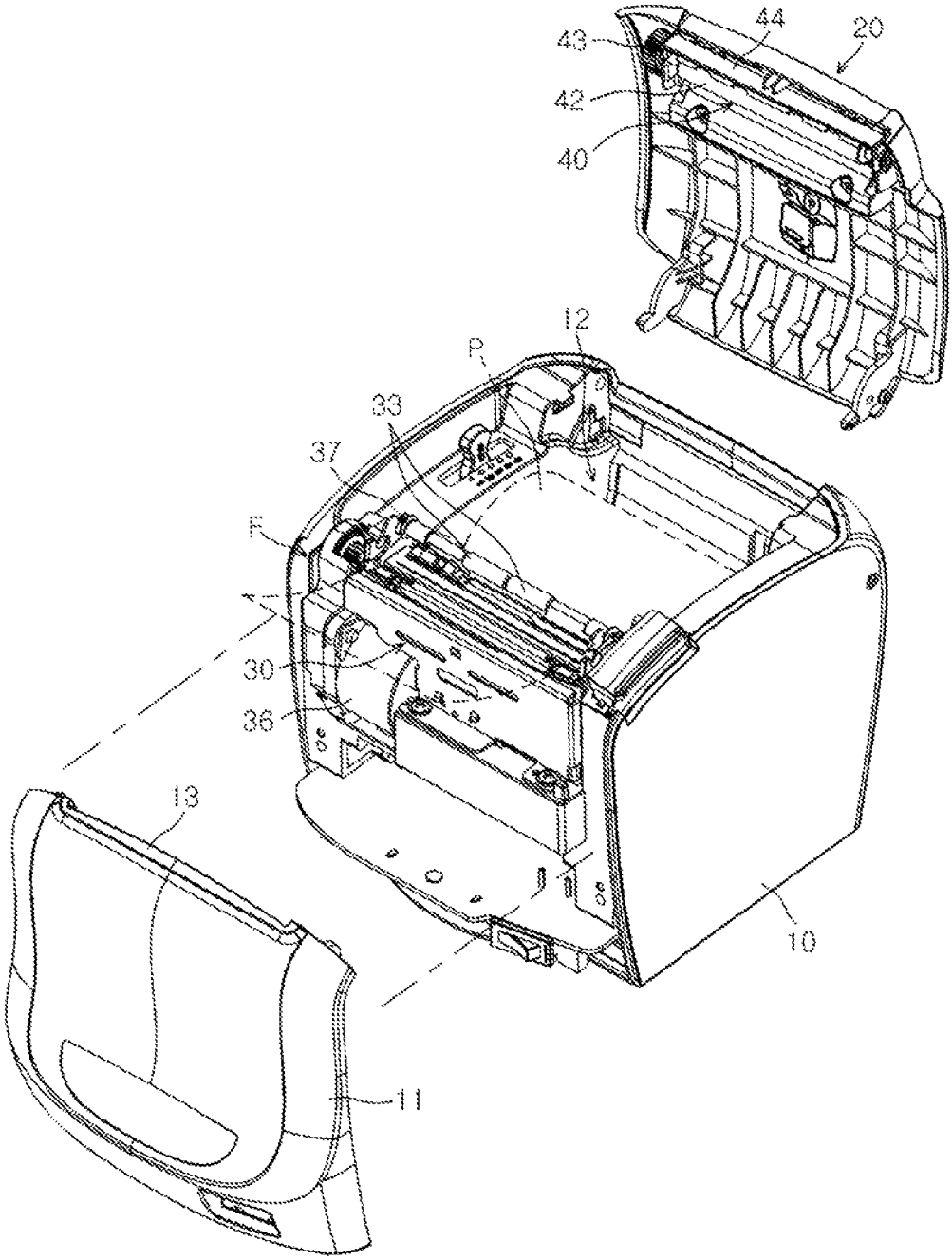
FIG. 3 is a perspective view illustrating the whole configuration of a printer according to an exemplary embodiment of the present disclosure.
Figure 4:
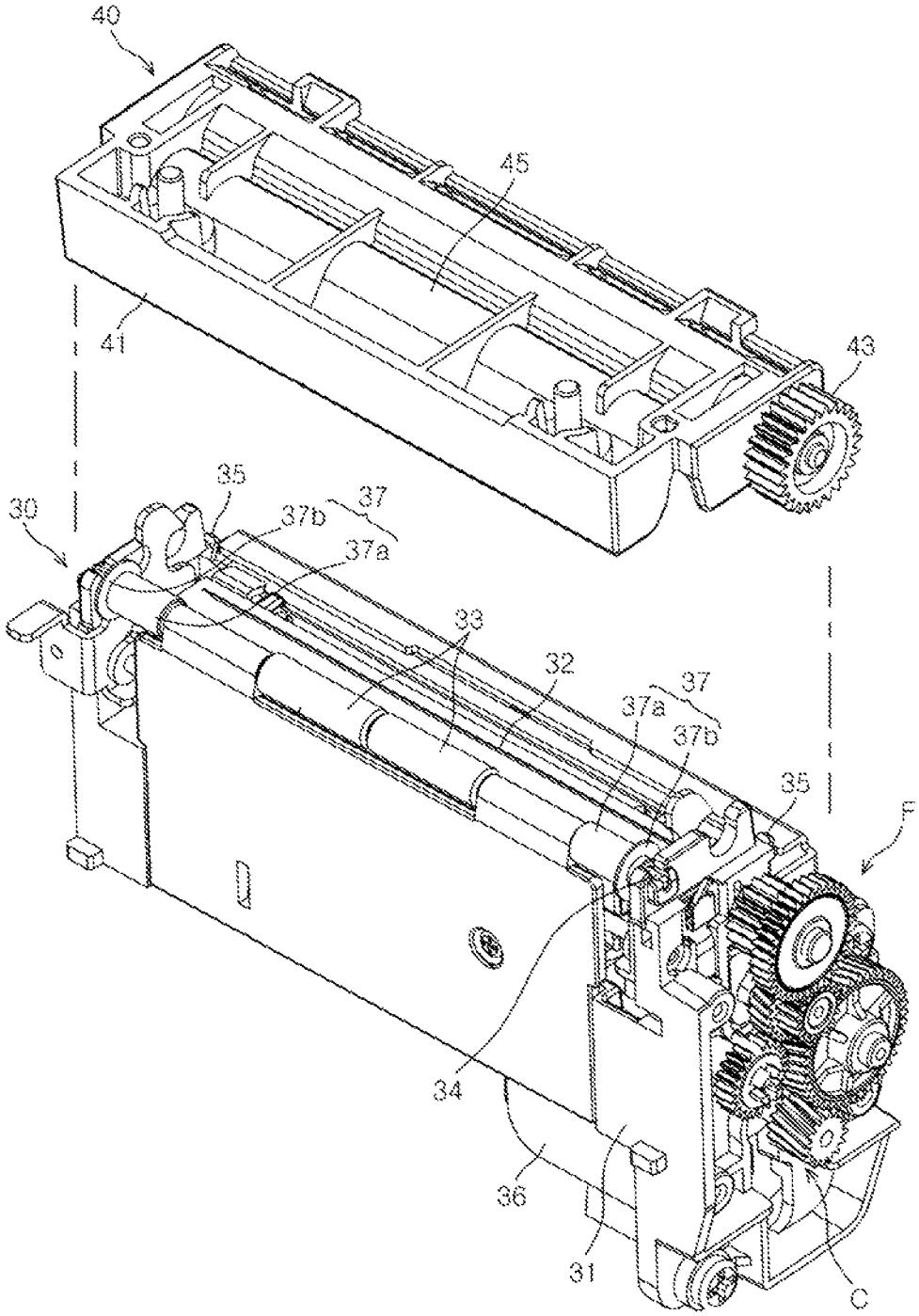
FIG. 4 is an exploded perspective view illustrating a printer head unit and a platen roller unit facing each other when a body casing and a cover frame are removed from the printer according to the exemplary embodiment of the present disclosure.
Figure 5:
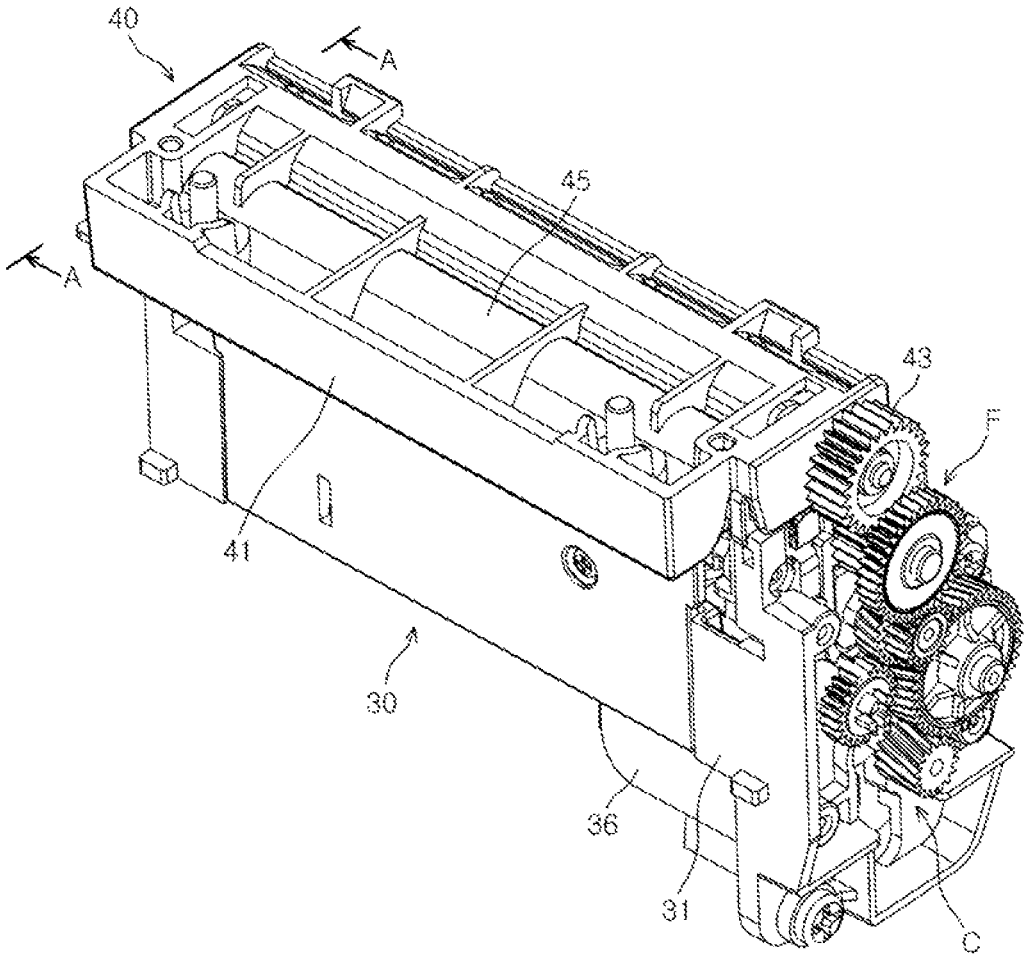
FIG. 5 is a perspective view illustrating the printer head unit and the platen roller unit engaged with each other when the body casing and the cover frame are removed from the printer according to the exemplary embodiment of the present disclosure.

As illustrated in FIGS. 3 to 5, a thermal printer to which the present disclosure is applied is configured to include a body casing 10 in which a printer head unit 30 for printing is mounted and a cover frame 20 in which a platen roller unit 40 disposed to face the printer head unit 30 while being rotatably opened and closed at an upper portion of a rear of the body casing 10. The body casing 10 is molded using plastic or metal materials to form an appearance of the thermal printer. A front surface of the body casing is separated into a front cover 11 and the body casing 10 is formed in an empty box shape of which the upper surface is opened through the cover frame 20.

The inside of the body casing 10 is provided with a receiving part 12 for receiving printing paper P illustrated by a dotted line in FIG. 3. The receiving part 12 is formed to have a size enough to receive the roll-shaped printing paper P, thereby stably receiving the roll-shaped printing paper P. An outer circumferential surface of a front cover with which the front cover 11 and a front end of the cover frame 20 contact is provided with a printing paper drawing port 13. Therefore, the printing paper P is drawn from the inside of the body casing 10 to an outside of the body casing 10 through the printing paper drawing port 13.

A front of the receiving part 10 is mounted with the printer head unit 30.

As illustrated in FIGS. 4 and 5, components for printing the printing paper P and components of a printing paper cutting apparatus for cutting the printing paper P are organically disposed in the printer head unit 30. That is, the printer head unit 30 is provided with a thermal printer head 32 performing printing (or writing) on the printing paper P conveyed from the receiving part 12 and a movable blade 35 for cutting the printing paper P. The thermal printer head 32 and the movable blade 35 are organically disposed on a support frame 31 which forms an overall frame of the printer head unit 30 and are coupled with each other.

The support frame 31 is a portion which forms the frame of the printer head unit 30, and the thermal printer head 32 is horizontally disposed at an upper portion of a center of the support frame 31. One side of the upper portion of the support frame 31 in front of the thermal printer head 32 is rotatably disposed with an idle roller 33 through a support shaft 34 of which both ends are fixedly supported on the support frame 31. The idle roller 33 is disposed in parallel with the thermal printer head 32 to participate in the conveyance of the printing paper P. Further, the movable blade 35 of the printing paper cutting apparatus which may be slid to cut the printed printing paper P up-and-down at a rear of the thermal printer head 32 is disposed on the support frame 31 at the other side of the idle roller 33.

Further, a side and a central portion of the support frame 31 are provided with a gear train C for cutting which is formed of a plurality of gear trains for driving the movable blade 35. Separately from the gear train C for cutting, the side of the support frame 31 is provided with a gear train F for conveyance in which a plurality of gears for driving a platen roller 42 serving to convey the printing paper P are organically gear-connected with each other. Further, one side of an inner wall of the support frame 31 is provided with a single power motor 36 which may optionally provide a driving force to the gear train C for cutting and the gear train F for conveyance. The gear train F for conveyance is the generic term for a combination of gears for delivering the driving force of the power motor 36 to the platen roller 42 side and the gear train F for conveyance is disposed on one side of the support frame 31 to be engaged with the platen gear 43 which is disposed at a shaft portion of one side of a platen roller 42. The gear train C for cutting is the generic term for a combination of gears for delivering the driving force of the power motor 36 to the movable blade 35 to drive the movable blade 35 configuring the printing paper cutting apparatus.

Figure 6:
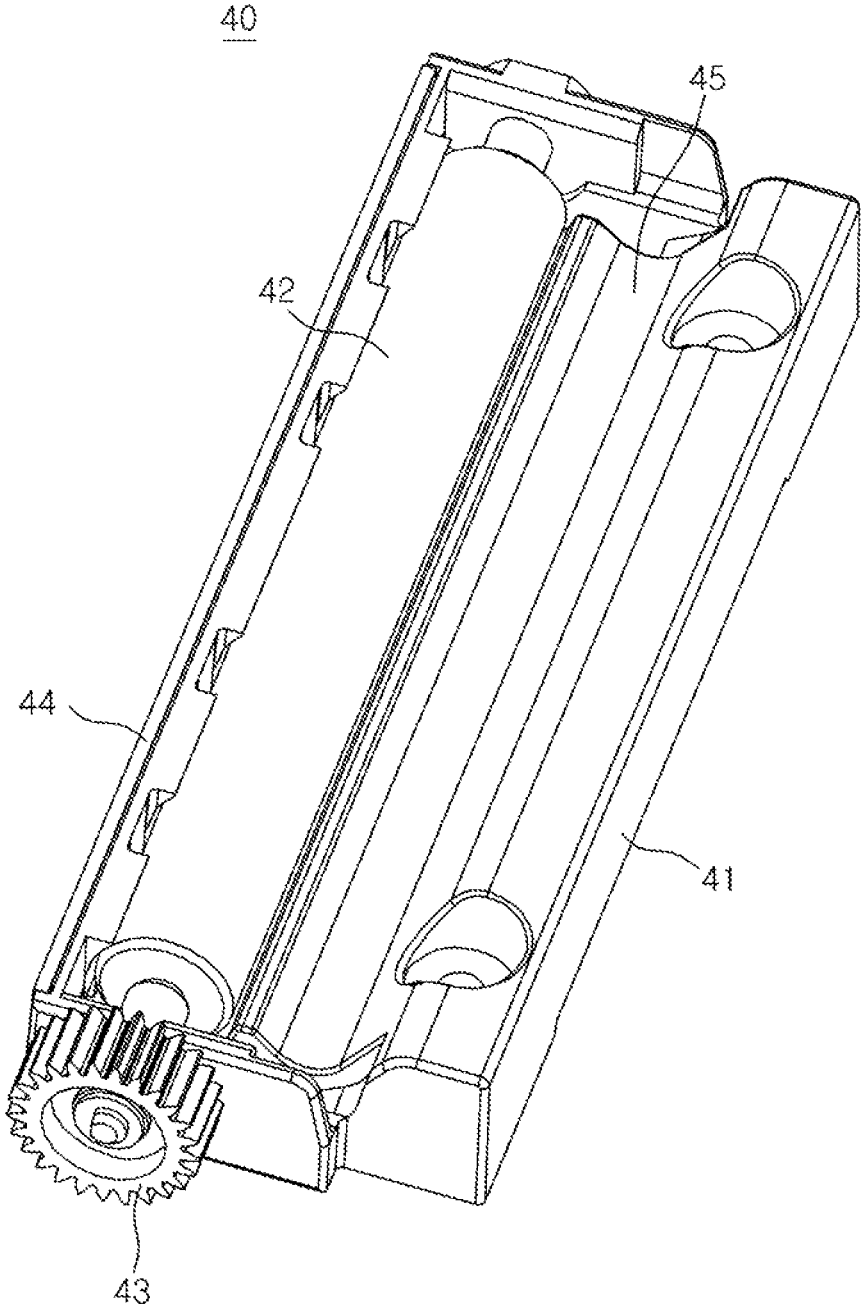
FIG. 6 is a perspective view illustrating a configuration of the printer roller unit in the printer according to the exemplary embodiment of the present disclosure.

Meanwhile, as illustrated in FIGS. 4 and 6, the platen roller unit 40 may be combined with the printer head unit 30 depending on the opening and closing of the cover frame 20 or it may be separated from the printer head unit 30. That is, when the cover frame 20 is closed on the upper surface of the body casing 10, the printer head unit 30 and the platen roller unit 40 are combined with each other to face each other.

The platen roller unit 40 includes a roller frame 41 which rotatably supports the platen roller 42 made of elastomer like rubber to convey the printing paper P. Further, the platen roller unit 40 is provided with a fixed blade 44 configuring the printing paper cutting apparatus at one side of the roller frame 41. The fixed blade 44 is vertically disposed on one side of the roller frame 41. One end of the platen roller 42 is fixed in the state in which a platen gear 43 is connected to the shaft part. The platen gear 43 is engaged with the gear train F for conveyance included in the support frame 31 to be sequentially supplied with the rotating driving force of the power motor 36 and thus serves to drive the platen roller 42. As such, the gear train F for conveyance which is disposed in the printer head unit 30 is engaged with the platen gear 43 which is disposed in the platen roller unit 40 to deliver the sequentially delivered rotating driving force to the platen roller 42.

When the thermal printer having the foregoing configuration intends to perform the printing job, the power motor 36 is first driven to deliver the driving force to the gear train F for conveying the printing paper and then rotate the platen roller 42. In this case, the printing paper P arranged to contact the platen roller 42 along the conveying path from the roll-shaped printing paper P received in the receiving part 12 is guided by the idle roller 33 towards the thermal printer head 32. After the thermal printer head 32 performs the printing job on the conveyed printing paper P, the printed printing paper P portion is conveyed to the outside of the body casing 10 through the printing paper drawing portion 13.

Finally, as the driving force of the power motor 36 is selected and delivered to the gear train C for cutting, the movable blade 35 of the printing paper cutting apparatus is driven to cut the printed portion of the printing paper drawn to the outside of the body casing 10, and the cut printed portion is provided to a user. In the thermal printer having the conveyance and cutting function of the printing paper P, the present disclosure provides an apparatus for effectively protecting occurrence of a skew phenomenon that the printing paper P is biased to one side during the conveyance of the printing paper P from the receiving part 12 to the thermal printer head 32 portion. That is, as illustrated in FIGS. 3 and 4 and FIGS. 7 and 8, according to the exemplary embodiment of the present disclosure, circular paper guides 37 are each installed at both ends of the support shaft 34 to convey the printing paper P while rotating the idle roller 33 and the circular paper guide 37 together at the time of the conveyance of the printing paper P.

Figure 8:
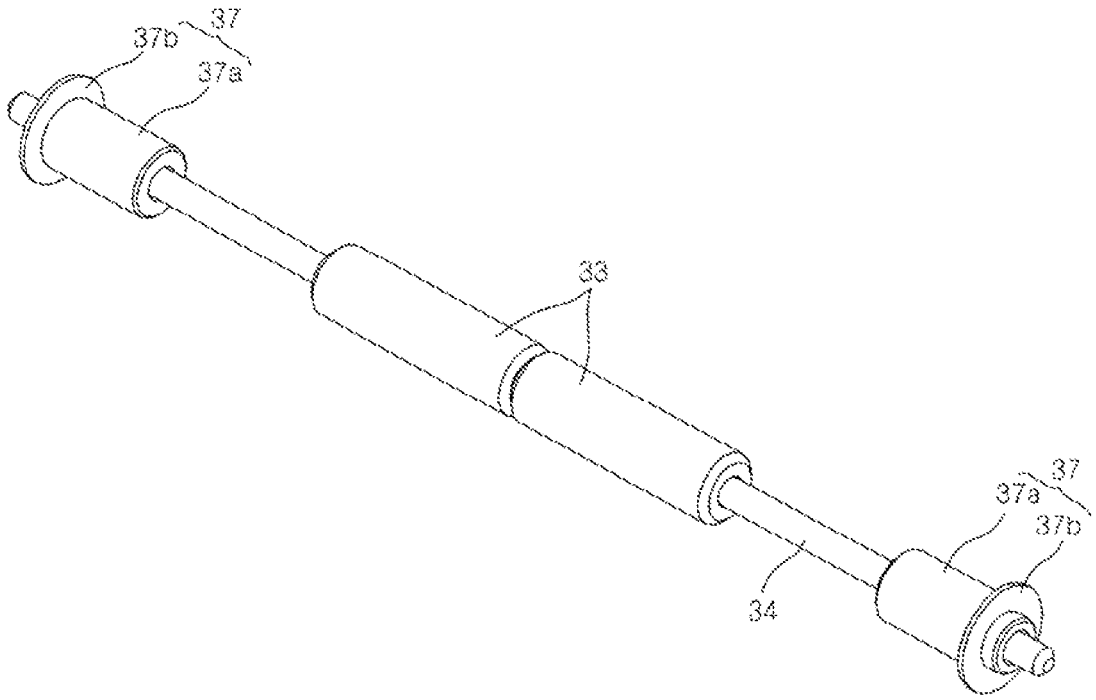
FIG. 8 is a perspective view illustrating a rotatably circular paper guide is mounted on a support shaft together with an idle roller according to an exemplary embodiment of the present disclosure.

In this case, as illustrated in FIG. 8, according to the exemplary embodiment of the present disclosure, the circular paper guide 37 is comprises cylindrical bodies 37*a* through which the support shaft 34 penetrates and a circular flange part 37*b* protruding in a flange form at one end of the cylindrical body 37*a* to serve as a fence. The circular paper guide 37 may be made of a metal material.

Further, in the paper guide 37, a diameter of an outer circumferential surface of the cylindrical body 37*a* is formed to have the same size as that of an outer circumferential surface of the idle roller 33. Therefore, the outer circumferential surface of the idle roller 33 and the outer circumferential surface of the cylindrical body 37*a* are positioned on the same horizontal line based on the support shaft 34. Thus a surface contacting the printing paper P is positioned on the same line such that the printing paper may be conveyed while maintaining a left and right balance during the conveyance guide process, thereby preventing the skew as the left and right balance of the printing paper is maintained.

Further, a distance (or interval) between the circular paper guides 37 which are disposed facing each other at both ends of the support shaft 34 is formed to be within an appropriate error range in consideration of the whole width of the printing paper P. In particular, the flange parts 37*b* of the paper guide 37 correctly hold the conveyed printing paper P while being biased to one side using the fence function to protect the occurrence of the skew, such that the distance (or interval) between the flange parts 37*b* which are disposed at both sides of the paper guides 37 may be formed to be positioned within the error range in which the skew does not occur over the whole width of the printing paper P.

As described above, at both ends of the support shaft 34 supporting and fixing the idle roller 33, the circular paper guide 37 may be penetratingly installed. Accordingly, the idle roller 33 and the circular paper guide 37 may be rotated together at the time of the printing job and convey and guide the printing paper P so as to remove the load due to the friction at the contact surface of the paper guide 37 contacting the printing paper P. As a result, the load due to the conveyance of the printing paper P may be minimized, and the occurrence of the skew due to the action of the flange part 37*b* of the paper guide 37 may be stably suppressed. Although not illustrated, the circular body 37*a* and the flange part 37*b* may be integrally formed and if necessary, the circular body 37*a* and the flange part 37*b* may also be formed separately.

Figure 9:
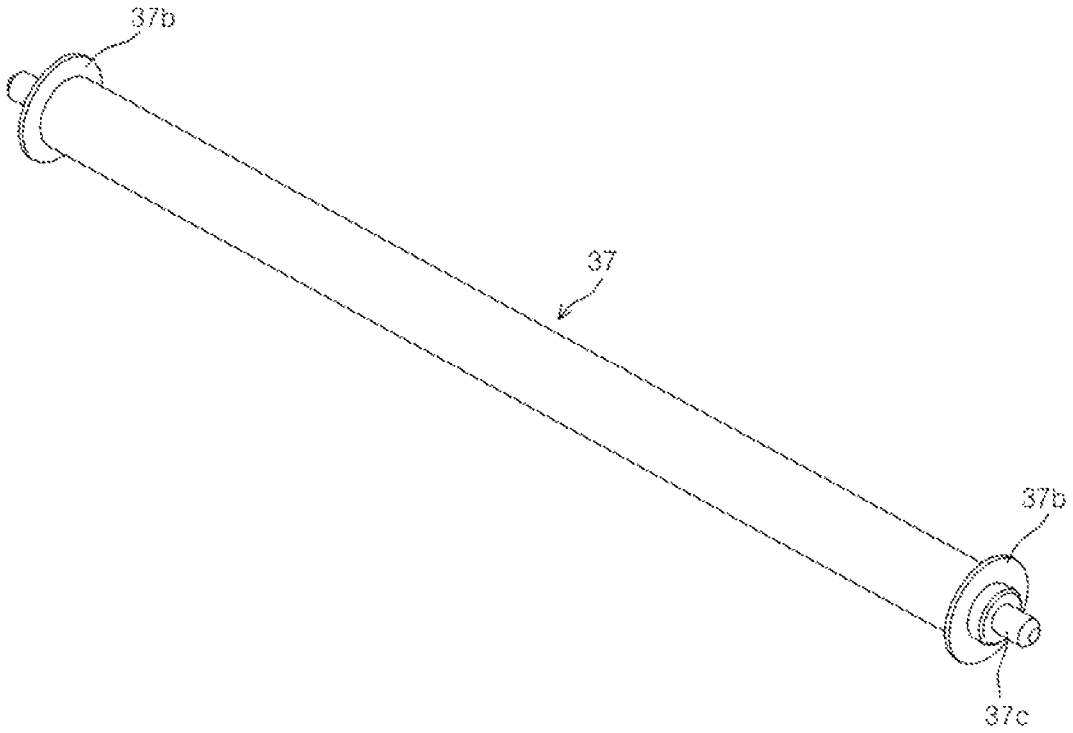
FIG. 9 is a perspective view illustrating a rotatably circular paper guide is mounted on the support shaft according to another exemplary embodiment of the present disclosure.

Meanwhile, the exemplary embodiment of the present disclosure describes, for example, the thermal printer in which the platen roller 42 and idle roller 33 to smoothly guide the conveyance of the printing paper P are included together. It is appreciated that even in a type in which only the platen roller 42 conveys the printing paper P without the help of the idle roller 33, a structure of preventing the skew from occurring using the circular paper guide 37 rotatably mounted may also be implemented. That is, according to another exemplary embodiment of the present disclosure, as illustrated in FIG. 9, the circular paper guide 37 having the flange part 37*b* while being rotated by the cylindrical body 37*a* integrally formed with the cylindrical axis 37*c* to guide the conveyance of the printing paper P together with the platen roller 42 on the conveyance path of the printing paper P without the presence of the idle roller 33 may be formed. It is very easy to change a design to prevent the skew from occurring using the rotatably circular paper guide 37.

As described above, the present disclosure does not provide the paper guide having the typically fixed fence structure but provides the circular paper guide 37 provided with the flange part 37*b* holding the side of the printing paper P while having the rotating structure depending on the conveyance of the printing paper P to remove the load due to the friction at the contact surface of the paper guide 37 contacting the printing paper P, thereby providing an apparatus for minimizing the load due to the conveyance of the printing paper P and stably suppressing the occurrence of the skew due to the action of the flange part 37*b* of the paper guide 37 on the conveying path of the printing paper P.

Figure 7:
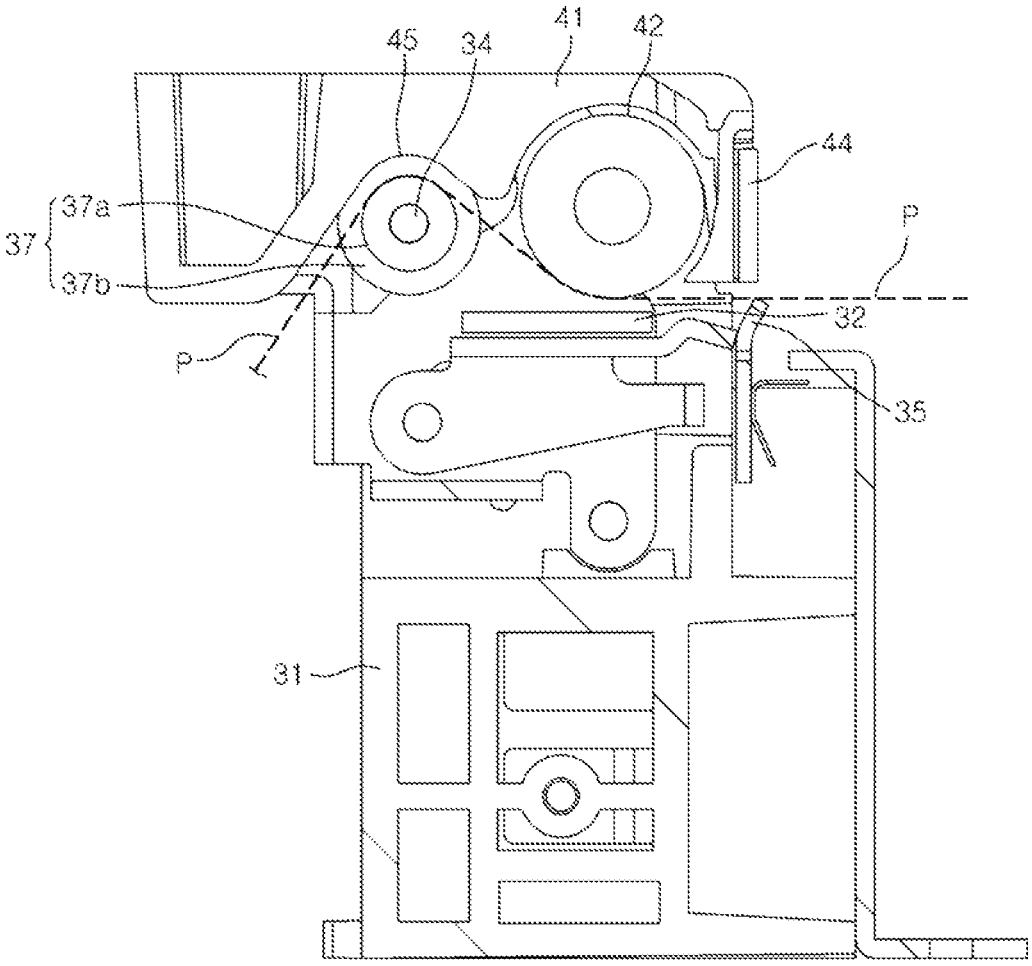
FIG. 7 is a schematic cross-sectional view taken along the line A-A illustrated in the FIG. 5.

Meanwhile, according to the exemplary embodiment of the present disclosure, as a scheme for more efficiently suppressing the occurrence of the skew of the printing paper P on the conveying path of the printing paper, a structure in which a semi-circular printing paper guide curved surface which may guide the conveyance of the printing paper P to meet the conveying path (or conveying trajectory) of the printing paper P is formed on the roller frame 41 is provided. That is, as illustrated in FIGS. 5 and 7, when the roller frame 41 is assembled at the upper portion of the support frame 31, the printing paper guide curved surface 45 is formed on an inner circumferential surface of the roller frame 41 as a semi-circular curved surface to closely couple the idle roller 33 with the circular paper guide 37 portion while enclosing the idle roller 33 and the circular paper guide 37 portion to face each other.

As such, when the semi-circular printing paper guide curved surface 45 is formed on the roller frame 41 to guide the printing paper P to be conveyed along the semi-circular curved surface, the printing paper needs to pass along the printing paper guide curved surface 45 having the semi-circular curved surface structure during the conveyance of the printing paper P, which is conveyed from the receiving part 12 through the circular paper guide 37. Accordingly, the printing paper P is conveyed to the paper guide 37 in a straight line form and thus is not conveyed in a line-contact state but is conveyed to the paper guide 37 in a semi-circular curved form and thus is conveyed in a surface-contact state to contact the printing paper P with the paper guide 37 without a relative sliding motion and form a condition to make the printing paper P strongly withstand the single-sided biasing of the printing paper, thereby efficiently suppressing the occurrence of the skew.

According to the exemplary embodiments of the present disclosure, the circular paper guides are additionally installed at each of both ends of the idle roller guiding the conveyance of the printing paper together with the platen roller to convey the printing paper while rotating the idle roller and the circular paper guide together at the time of the printing job so as to remove the load due to the friction of the printing paper with the paper guides, thereby minimizing the load due to the conveyance of the printing paper and stably suppressing the occurrence of the skew due to the action of the paper guides.

Further, according to the exemplary embodiments of the present disclosure, the printing paper guide curved surface having the semi-circular structure in which the idle roller and the circular paper guide are enclosed to face each other is formed on the roller frame mounted with the platen roller to limit the moving trajectory of the printing paper between the printing paper guide curved surface of the roller frame and the paper guide to convey the printing paper to the outer circumferential surface of the idle roller in the semi-circular form, and as a result, the printing paper contacts the paper guide positioned on the same line as the idle roller without the relative sliding motion with respect to the paper guide while being conveyed in the semi-circular form even though the printing paper is biased to one side to form the condition to make the printing paper strongly withstand the single-sided biasing of the printing paper, thereby efficiently suppressing the occurrence of the skew.

Further, according to the exemplary embodiments of the present disclosure, the occurrence of the skew may be stably suppressed to relatively easily manage the tolerance at the time of manufacturing the printer, thereby saving the manufacturing costs.

Further, according to the exemplary embodiments of the present disclosure, the load due to the friction of the printing paper during the conveyance of the printing paper for the printing job is minimized to reduce the driving load of the printer mechanism, thereby improving the printing speed of the printer.

Finally, the paper guide applied to the apparatus for protecting a skew of a printer according to the exemplary embodiments of the present disclosure rotates together with the idle roller without relatively sliding between the paper guide and the printing paper during the conveyance of the printing paper to minimize the load due to the friction, thereby suppressing the occurrence of failure due to the scratch at the contact portion of the paper guide with the front ends of both sides of the printing paper.

Hereinabove, the exemplary embodiments of the present disclosure are illustrated and described, but the present disclosure is not limited to the above-mentioned specific exemplary embodiment and may be variously modified by those skilled in the art to which the present disclosure pertains without departing from the gist of the present disclosure as defined by the following claims. In addition, these modifications are to fall within the scope of the following claims.

What is claimed is:

1. An apparatus for protecting a paper skew of a printer, comprising:

a printer head unit comprising:

a support shaft installed on a support frame and a thermal printer head installed on the support frame to print printing paper; and an idle roller inserted into the support frame to convey the printing paper;

a platen roller unit comprising a roller frame and a platen roller; and paper guides installed at both sides of the support shaft to guide a conveyance of the printing paper by contacting the printing paper.

2. The apparatus of claim 1, wherein the paper guide comprises:

bodies configured to protrude at both ends of the support shaft; and flange parts formed at the both ends of the support shaft and the flange parts protruding more than a diameter of an outer circumferential surface of the bodies.

3. The apparatus of claim 2, wherein the flange parts of the paper guides are integrally formed with the bodies and the flange parts protrude from front ends of each of the bodies along the outer circumferential surface of the bodies.

4. The apparatus of claim 3, wherein the bodies are formed to flank the idle roller and to face each other at the both ends of the support shaft.

5. The apparatus of claim 4, wherein the diameter of the outer circumferential surface of the bodies is configured to be the same as that of an outer circumferential surface of the idle roller.

6. The apparatus of claim 1, wherein the paper guides comprise:

bodies formed to protrude along a length direction of the support shaft; and flange parts formed at both ends of the support shaft, and the flange parts protruding more than a diameter of an outer circumferential surface of the bodies.

7. The apparatus of claim 6, wherein the bodies are integrally formed with the support shaft.

8. The apparatus of claim 1, wherein the platen roller unit further comprises a printing paper guide curved surface formed on the roller frame to guide a conveyance of the printing paper, and wherein the printer head unit further comprises an idle roller inserted into the support frame to convey the printing paper.

9. The apparatus of claim 8, wherein the printing paper guide curved surface is formed on the roller frame as a semi-circular curved surface to closely couple the idle roller with the paper guides while enclosing the idle roller and the paper guides to face each other.

10. The apparatus of claim 9, wherein the printer head unit further comprises a movable blade installed on the support frame to face the idle roller and the movable blade configured to cut a printed version of the printing paper.

11. The apparatus of claim 10, wherein the platen roller unit further comprises a fixed blade installed at one side of the roller frame to cut the printing paper by driving the movable blade up-and-down.

12. An apparatus for protecting a paper skew of a printer, comprising:

a printer head unit comprising:

a support shaft installed on a support frame and a thermal printer head installed on the support frame to print printing paper;

an idle roller inserted into the support frame to convey the printing paper; and bodies formed to flank the idle roller and to face each other at both ends of the support shaft;

a platen roller unit comprising a roller frame and a platen roller; and paper guides formed at both sides of the support shaft.

13. The apparatus of claim 12, wherein a diameter of an outer circumferential surface of the bodies is configured to be the same as that of an outer circumferential surface of the idle roller.

14. An apparatus for protecting a paper skew of a printer, comprising:

a printer head unit comprising:

a support shaft installed on a support frame and a thermal printer head installed on the support frame to print printing paper;

an idle roller inserted into the support frame to convey the printing paper; and a movable blade installed on the support frame to face the idle roller and the movable blade configured to cut a printed version of the printing paper;

a platen roller unit comprising a roller frame and a platen roller; and paper guides formed at both sides of the support shaft.

15. The apparatus of claim 14, wherein the platen roller unit further comprises a printing paper guide curved surface formed on the roller frame to guide a conveyance of the printing paper.

16. The apparatus of claim 15, wherein the printing paper guide curved surface is formed on the roller frame as a semi-circular curved surface to closely couple the idle roller with the paper guides while enclosing the idle roller and the paper guides to face each other.

17. The apparatus of claim 16, wherein the platen roller unit further comprises a fixed blade installed at one side of the roller frame to cut the printing paper by driving the movable blade up-and-down.

18. The apparatus of claim 17, wherein the paper guides comprise:

bodies configured to protrude at both ends of the support shaft; and flange parts formed at the both ends of the support shaft and the flange parts protruding more than a diameter of an outer circumferential surface of the bodies.

19. The apparatus of claim 18, wherein the flange parts of the paper guides are integrally formed with the bodies and the flange parts protrude from front ends of each of the bodies along the outer circumferential surface of the bodies.

20. The apparatus of claim 19, wherein the bodies are configured to flank the idle roller and to face each other at the both ends of the support shaft.

* * * * *